US007214239B2

(12) United States Patent
Chen

(10) Patent No.: US 7,214,239 B2
(45) Date of Patent: May 8, 2007

(54) ANTI-SWALLOW PACIFIER WITH BIVALVE SHELL

(75) Inventor: Chean-Shui Chen, No. 33, Alley 16, Lane 313, Hsi-An Street, Sec. 1, Peitou, Taipei (TW) 112

(73) Assignee: Chean-Shui Chen, Taipei (TW)

( * ) Notice: Subject to any disclaimer, the term of this patent is extended or adjusted under 35 U.S.C. 154(b) by 426 days.

(21) Appl. No.: 10/851,558

(22) Filed: May 22, 2004

(65) Prior Publication Data

US 2005/0261739 A1 Nov. 24, 2005

(51) Int. Cl.
*A61J 17/00* (2006.01)

(52) U.S. Cl. ..... 606/236; 606/234; 24/194

(58) Field of Classification Search ..... None
See application file for complete search history.

(56) References Cited

U.S. PATENT DOCUMENTS 4,417,613 A * 11/1983 Ryan et al. ..... 215/11.6
5,156,617 A * 10/1992 Reid ..... 606/234
5,578,058 A * 11/1996 Chen ..... 606/236
5,810,886 A * 9/1998 Hassan ..... 606/234

* cited by examiner

*Primary Examiner*—Glenn K. Dawson

(57) ABSTRACT

An anti-swallow pacifier includes: a base member having nipple member protruding forwardly from the base member, a bivalve shell having a pair of half-shell pieces hingedly secured to the base member having a restoring spring retained on the base member for resiliently automatically closing the two half-shell pieces for covering the nipple portion, an anti-swallow shield circumferentially formed on a rear portion of the base member for preventing from swallow of the pacifier by a baby as the shield may be obstructed beyond the baby's mouth without being swallowed, and a handle secured to the anti-swallow shield.

9 Claims, 6 Drawing Sheets

ANTI-SWALLOW PACIFIER WITH BIVALVE SHELL

BACKGROUND OF THE INVENTION

U.S. Pat. No. 5,578,058 (the prior art) issued to the same inventor of this application disclosed a hygienic pacifier having a bivalve shell hingedly secured to the base member for closing the nipple portion protruding from the base member for preventing contamination of the nipple portion.

However, such a prior art still has the following drawbacks:

1. When the two half-shell pieces (31) are opened for baby's soothing, the two half-shell pieces (31) will be obstructed beyond the baby's mouth, being unable to be swallowed by the baby. However, when the bivalve shall (3) is closed, the pacifier may be possibly swallowed by a baby to possibly cause baby's fatal suffocation.
2. It is lacking of automatic closing mechanism for closing the bivalve shell (3). Even a pair of meshed gears 34*a* are provided for simultaneously closing the two half-shell pieces (31), at least one half-shell piece (31) should be continuously driven for closing the two half-shell pieces, still being inconvenient for closing the bivalve shell for protecting the nipple portion.

The present inventor has found the drawbacks of the prior art and invented the present anti-swallow pacifier.

SUMMARY OF THE INVENTION

The object of the present invention is to provide an anti-swallow pacifier including: a base member having nipple member protruding forwardly from the base member, a bivalve shell having a pair of half-shell pieces hingedly secured to the base member having a restoring spring retained on the base member for resiliently automatically closing the two half-shell pieces for covering the nipple portion such as when the pacifier is dropped to the ground, an anti-swallow shield circumferentially formed on a rear portion of the base member for preventing from swallow of the pacifier by a baby as the shield may be obstructed beyond the baby's mouth without being swallowed. A handle may be further secured to the anti-swallow shield.

DETAILED DESCRIPTION

Figure 1:
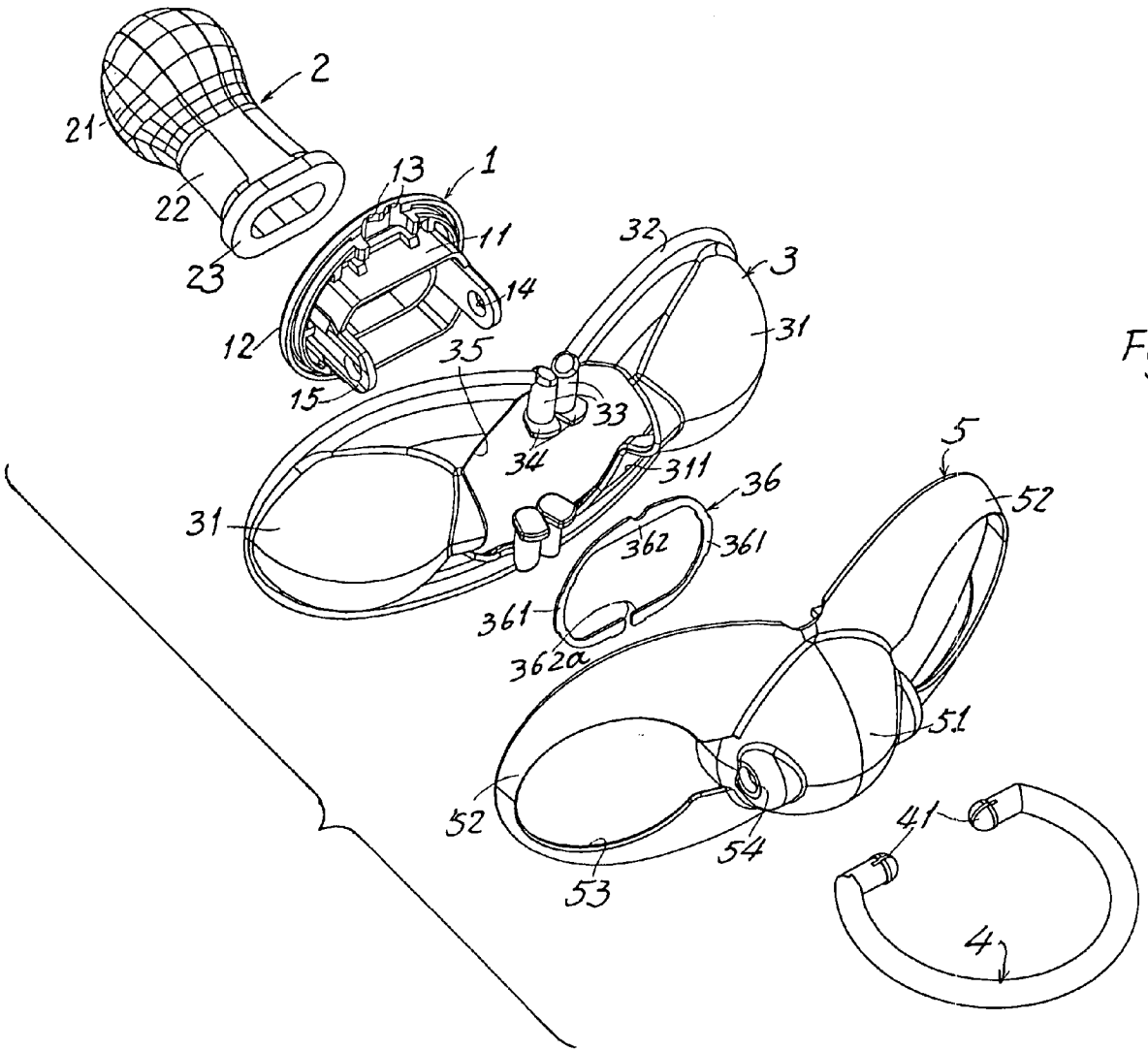
FIG. 1 is an exploded view showing the elements of the present invention.

As shown in the drawing figures, the present invention comprises: a base member 1; a nipple member 2 formed on a front portion of the base member 1; a bivalve shell 3 hingedly secured to the base member 1; an anti-swallow shield 5 circumferentially secured to the base member 1 allowing a rearward protruding of the bivalve shell 3 (when opened) and for retarding the pacifier beyond a baby's mouth for safely preventing from swallowing of the pacifier into the baby's mouth, throat or trachea; and a handle 4 secured to the shield 5 or secured to the base member 1.

Figure 2:
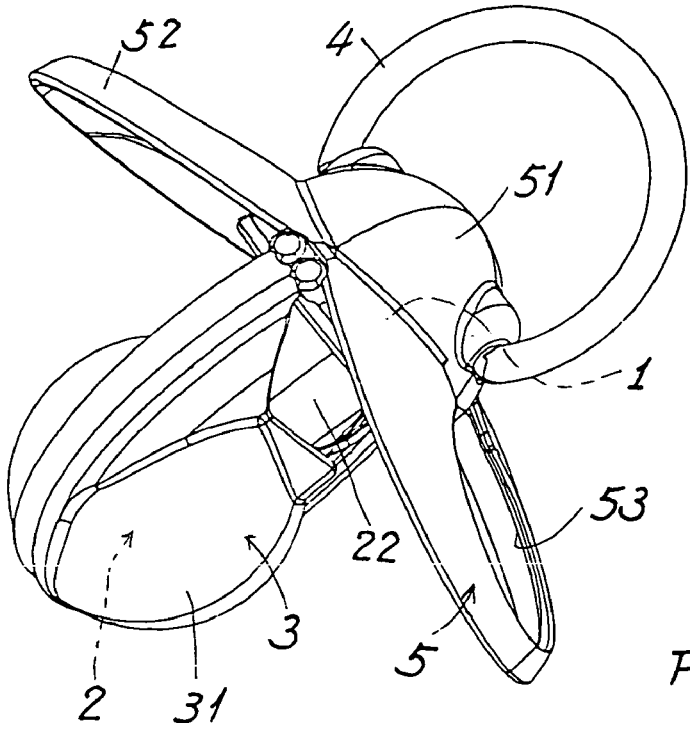
FIG. 2 is a perspective view of the present invention.

The shapes or structures of the shield 5 are not limited in this invention. The typical examples of the shield 5 are respectively shown in FIG. 1 (or FIG. 2) and in FIG. 8.

The base member 1 includes a base 11 for forming the nipple member 2 on a front portion of the base 11 and for fixing the anti-swallow shield 5 on a rear portion of the base 11, a cover 12 formed on a front portion of the base 11 allowing the nipple member 2 protruding forwardly through a central portion of the cover 12, two pairs of double pivot holes (i.e., four pivot holes) 13 diametrically formed on a front rim portion of the base 11 adjacent to the cover 12 for respectively pivotally engaging the two half-shell pieces 31 of the bivalve shell 3 for pivotally securing the bivalve shell 3 on the base member 1, and a pair of pin holes 14 formed in two lugs 15 protruding rearwardly from the base 11 for pivotally engaging the two ratchet-toothed pins 41 of the handle 4 through the anti-swallow shield 5.

The nipple member 2 includes a nipple portion 21 formed on a front end of a shank portion 22 protruding forwardly from the base member 1 and a flange portion 23 formed on a rear end of the shank portion 22 to be secured in the base member 1.

Figure 6:
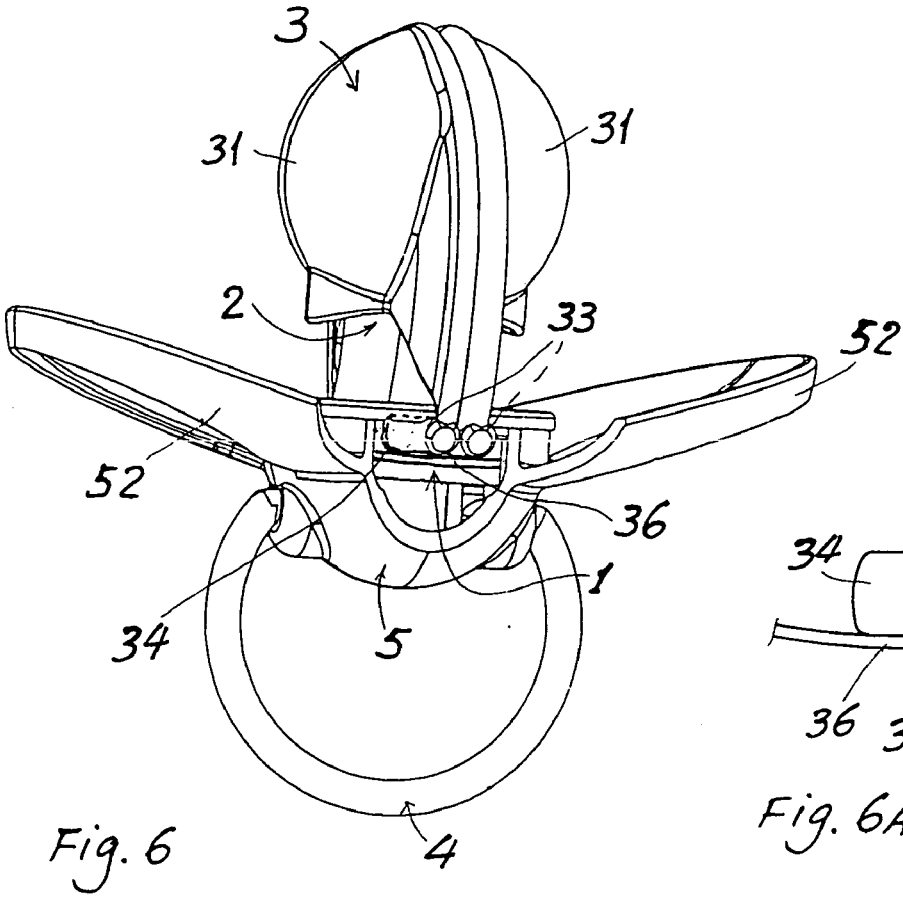
FIG. 6 shows a closed bivalve shell of the present invention.
Figure 6A:
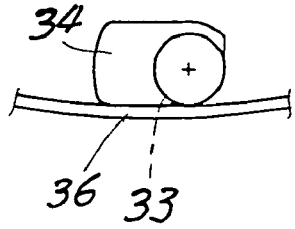
FIG. 6A shows the cam portion with the restoring spring in FIG. 6.

The bivalve shell 3 includes: a pair of half-shell pieces 31 each having a pair of pivots 33 formed on two opposite pivotal portions 311 each pivot 33 pivotally engaged in each pivot hole 13 formed in the base member 1, and each half-shell piece 31 having a peripheral ring portion 32 formed on a periphery of the half-shell piece 31, and each pivot 33 having a cam portion 34 perpendicularly secured to the pivot 33 to be resiliently tensioned by a restoring spring 36 retained on the base member 1, and each half-shell piece 31 defining a notch 35 within the two pivotal portions 311 allowing a free opening of the two half-shell pieces 31 when rearly opened to prevent from being obstructed by the front cover 12 of the base member 1; whereby upon engaging two pivots 33 of two half-shall pieces 31 in the two pivot holes 13 in the base member 1, the two half-shell pieces 31 will be pivotally secured to the base member 1 to combinably encase the nipple portion 21 within the two half-shell pieces 31 (FIG. 6). The cam portion 34 may also serve as a stopper to be pivotally limited in the base member to prevent from releasing of the shell 3 from the base member 1 and the anti-swallow shield 5 when opening or closing the shell.

The restoring spring 36 is formed as a ring member and includes a pair of fixing end portions 361 diametrically retained in a front rim portion of the base member 1, or retained in two retaining portions formed in the anti-swallow shield 5 adjacent to the front portion of the base 11; and two movable forcing portions 362, 362*a* each movable forcing portion 362 or 362*a* angularly deviated from each fixing end portion 361 in a right angle (FIG. 7), and each movable forcing portion 362 or 362*a* resiliently urging each cam portion 34 of each half-shell piece 31 for normally resiliently closing the two half-shell pieces 31 for encasing the nipple portion 21 therein (such as when dropped downwardly to the ground).

Figure 7:
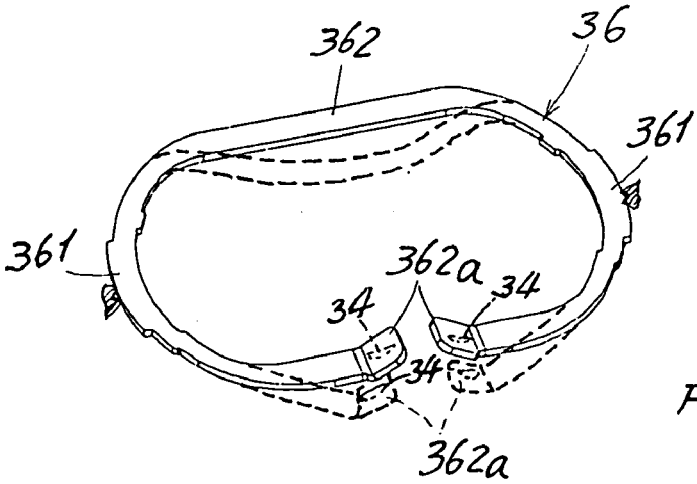
FIG. 7 is an illustration of the restoring spring of the present invention.

One movable forcing portion may be formed as an open ring portion 362*a* so that upon extension of the two movable forcing portions 362, 362*a* of the restoring spring 36 as shown in FIG. 7 (dotted line), such an open ring portion 362*a* may allow the extension of the spring 36 as biased by the two cam portions 34 formed on the pivots 33 of the half-shell pieces 31.

Figure 3:
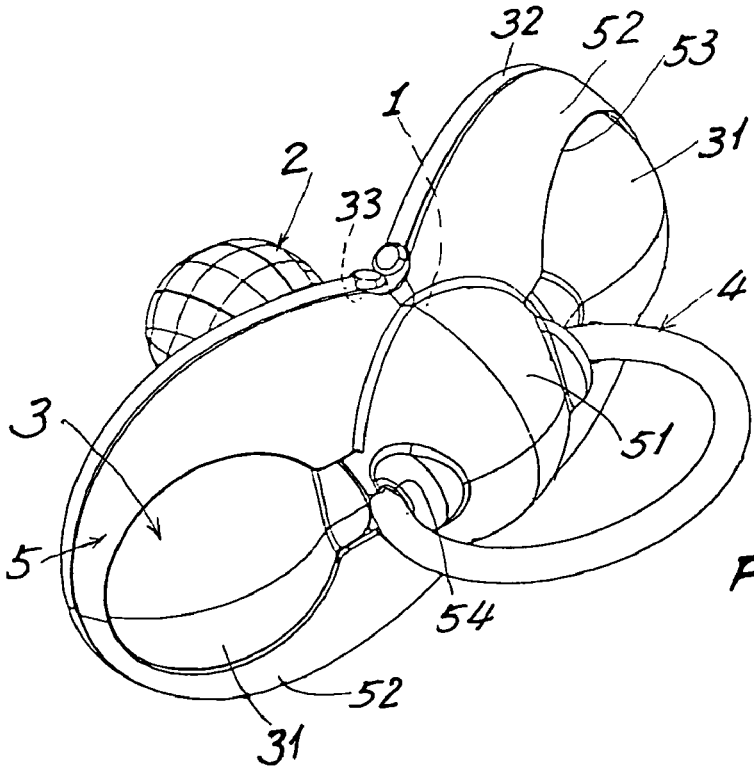
FIG. 3 is a rear-view perspective illustration of the present invention.

The anti-swallow shield 5 includes: a cap portion 51 secured to a rear portion of the base member 1 (e.g., the cap portion having a plug to be engaged with a central hole formed in the shank portion 22 of the nipple member 2 and the nipple member 2 already fixed in the base member 1 to thereby secure the cap portion 51 with the base member), a pair of wing portions 52 disposed on opposite sides of the cap portion 51, each wing portion 52 having an opening 53 formed therein for rearwardly protruding each half-shell piece 31 of the bivalve shell 3 through the opening 53 when opened (FIGS. 3 & 4) for stably opening the bivalve shell 3 (without retarding the rearward protruding of the half-shell piece 31) allowing a smooth soothing of the nipple portion 21 by a baby. The opening 53 may also serve as a ventilation opening to prevent from a baby's suffocation.

The cap portion 51 of the anti-swallow shield 5 includes two outer pin holes 54 formed through the cap portion 51 for passing each of the two ratchet-toothed pin 41 of the handle 4 through each outer pin hole 54 to be engaged in each pin hole 14 formed in the base member 1, thereby allowing a pivotal connection of the handle 4 to the base member 1 through the anti-swallow shield 5.

The two wing portions 52 are integrally formed with the cap portion 51 of the shield. Of course, the two wing portions 52 may also be separated from the cap portion 51, and then secured or assembled to the cap portion 51.

Figure 8:
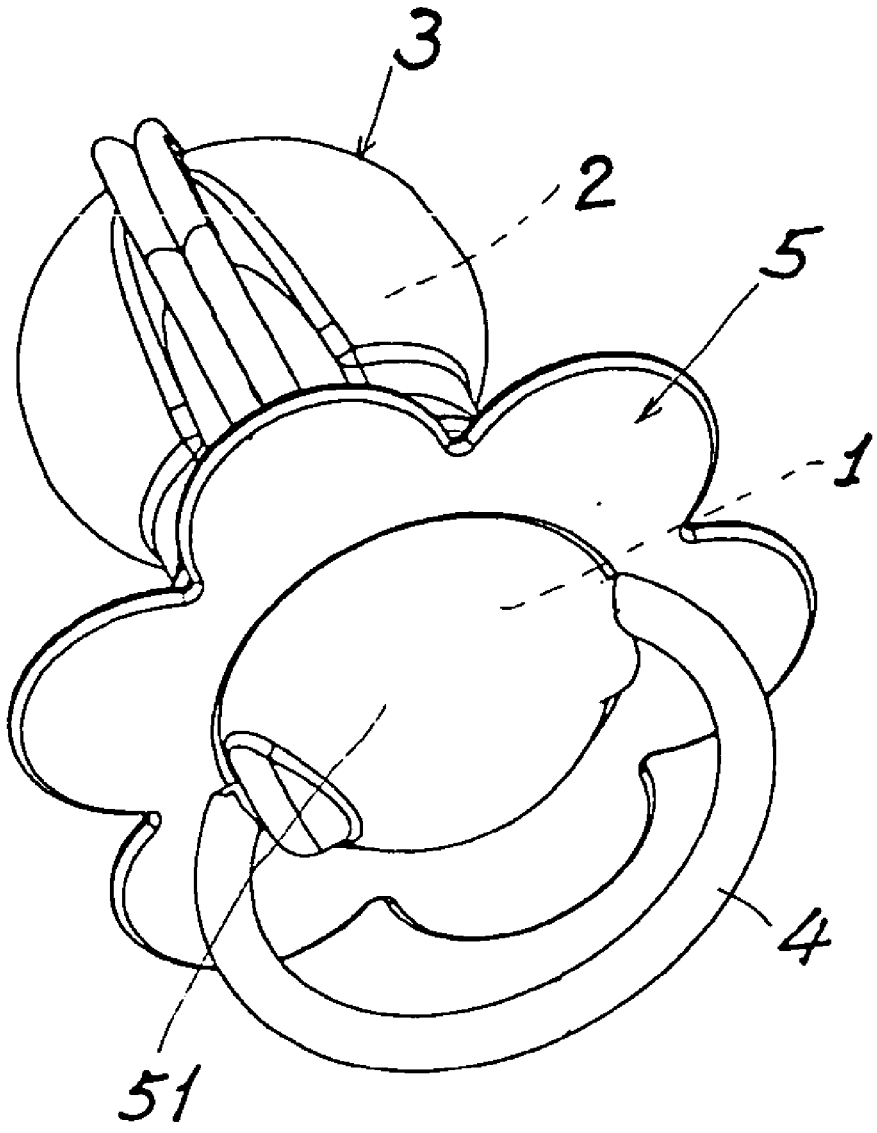
FIG. 8 is a rear-view perspective drawing showing another preferred embodiment of the present invention.

The shield 5 may be formed as a flower shape as illustrated in FIG. 8 (or other shapes).

The nipple member 2, the base member 3 and the anti-swallow shield 5 may be integrally formed.

The anti-swallow shield 5 should have a size or area larger than an average opening area of a baby's mouth to prevent from swallow of the pacifier into the baby's mouth or trachea.

The present invention is superior to the prior art because the anti-swallow shield 5 may prevent from swallow of the pacifier by a baby and the automatic resilient closing of the two half-shell pieces 31 of the bivalve shell 3 for protecting of the pacifier when dropped to the ground.

Figure 4:
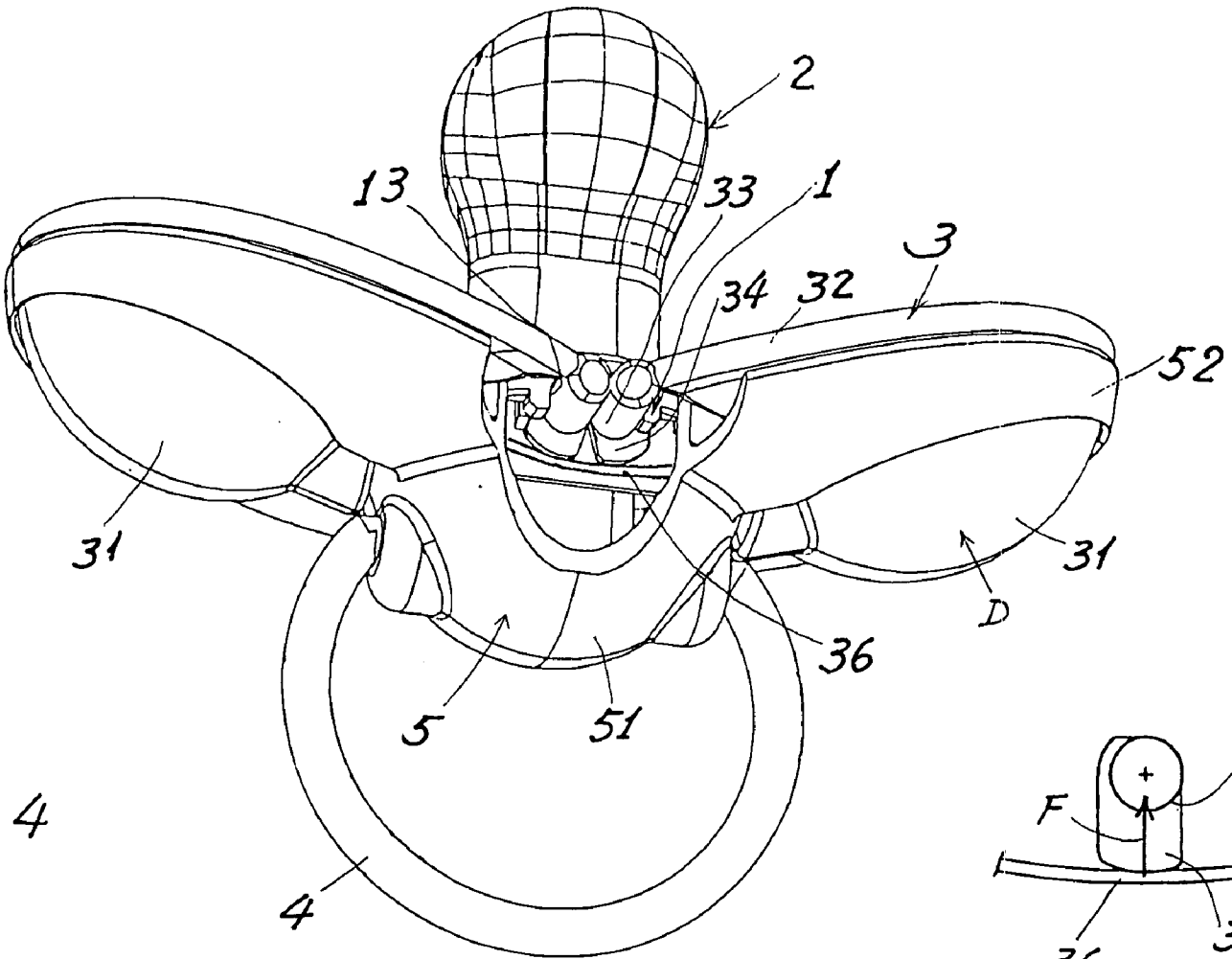
FIG. 4 is an illustration of the present invention showing the opening of the two half-shell pieces.
Figure 4A:
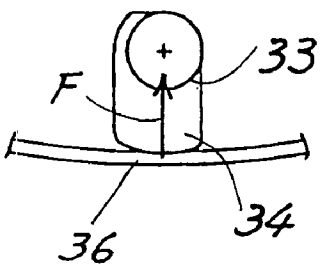
FIG. 4A shows the relationship of the cam portion with the restoring spring in FIG. 4.
Figures 5, 5A:
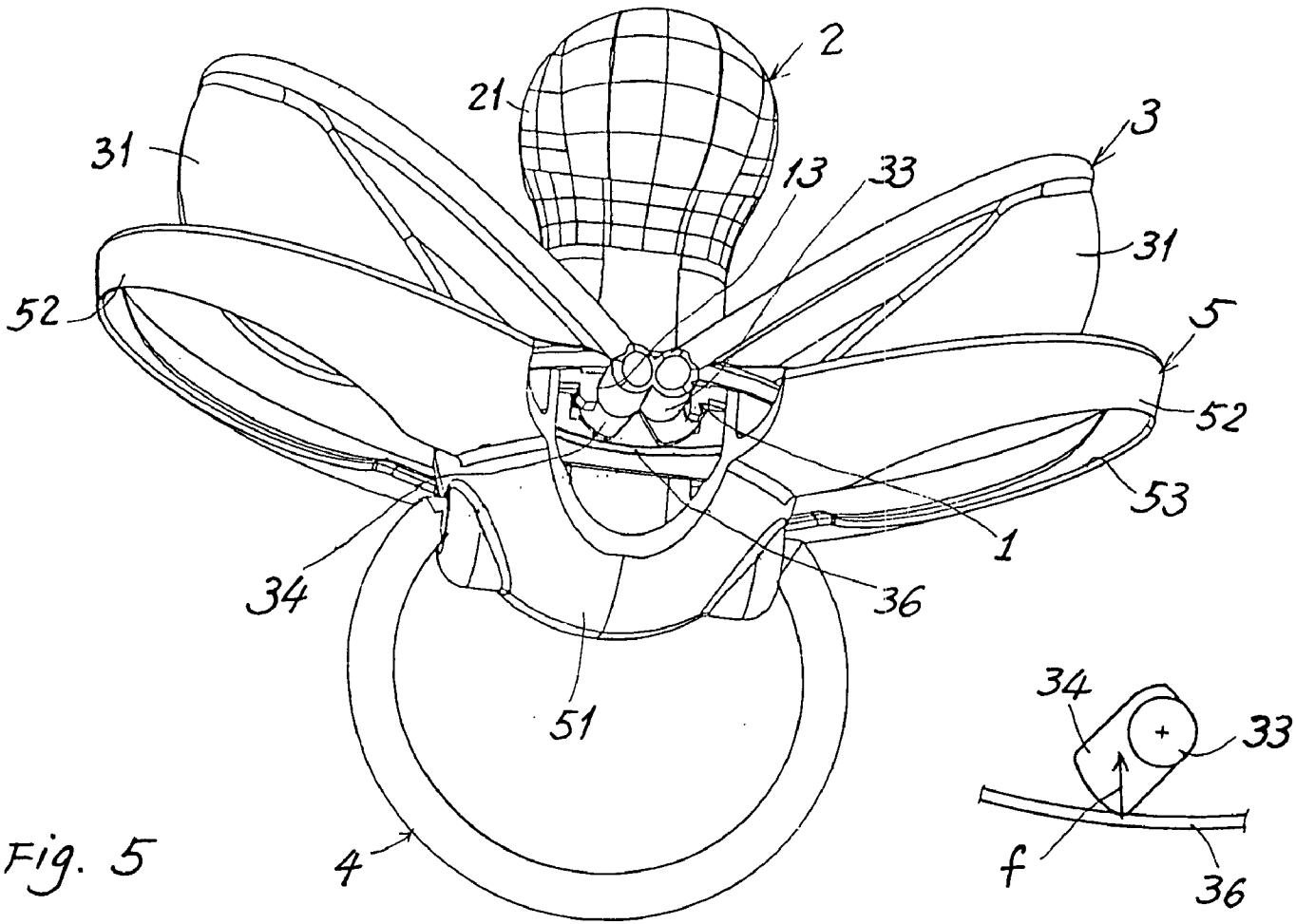
FIG. 5 shows the initiating for closing the bivalve shell after FIG. 4.
FIG. 5A shows the relationship of the cam portion with the restoring spring in FIG. 5.

The automatic resilient closing operation of the bivalve shell 3 may be clearly described hereinafter with reference to FIGS. 4~6. When opening the shell 3, the resilience F of the spring 36 will force at the pivot center without biasing the half-shell piece 31 to thereby stably open the shell (FIG. 4, 4A).

When closing the bivalve shell 3, an initial depression D may be actuated on any one of the half-shell piece 31 (FIG. 4 to FIG. 5) to produce a biasing force "f" acting on the cam portion 34 of the half-shell piece 31 (FIG. 5, 5A, like a lever action) to thereby drive a rotation movement of the half-shell piece 31 about the pivot 33. The resilience of the restoring spring 36 will urge the cam portions 34 of the two half-shell pieces 31 to finally close the two half-shell pieces 31 for encasing the nipple portion 21 in the shell 3 (FIG. 6, 6A) for a hygienic protection of the nipple portion 21 when dropped to the ground.

The present invention may be modified without departing from the spirit and scope of the present invention.

I claim:

1. A pacifier comprising:

a base member;

a nipple member formed on a front portion of the base member;

a bivalve shell hingedly secured to the base member; and an anti-swallow shield circumferentially secured to the base member having openings formed in said shield allowing a rearward protruding of the bivalve shell when opened for safely preventing the swallowing of the pacifier.

2. A pacifier according to claim 1, wherein said base member includes a base for forming the nipple member on a front portion of the base and for, fixing the anti-swallow shield on a rear portion of the base, a cover formed on a front portion of the base for protruding the nipple member forwardly through a central portion of the cover, four pivot holes formed on a front rim portion of the base adjacent to the cover for respectively pivotally engaging four pivots of the two half-shell pieces of the bivalve shell in the pivot holes for pivotally securing the bivalve shell on the base member, and a pair of pin holes formed in two lugs protruding rearwardly from the base for pivotally engaging two ratchet-toothed pins formed on a handle by passing the pins through the anti-swallow shield.

3. A pacifier according to claim 2, wherein said bivalve shell includes: a pair of half-shell pieces each having a pair of pivots formed on two opposite pivotal portions each said pivot pivotally engaged in each pivot hole formed in the base member, and each said pivot having a cam portion perpendicularly secured to the pivot to be resiliently tensioned by a restoring spring retained on the base member, and each said half-shell piece defining a notch within the two pivotal portions for a free opening of the two half-shell pieces when rearly opened; whereby upon engaging two said pivots of two said half-shall pieces in the two pivot holes in the base member, the two half-shell pieces will be pivotally secured to the base member to combinably encase the nipple portion within the two half-shell pieces.

4. A pacifier according to claim 3, wherein said restoring spring is formed as a ring member diametrically retained in the base member and in said anti-swallow shield; having two movable forcing portions resiliently urging each said cam portion of each said half-shell piece for normally resiliently closing the two half-shell pieces for encasing the nipple portion therein.

5. A pacifier according to claim 4, wherein one said movable forcing portion is formed as an open ring portion so that upon extension of the two movable forcing portions of the restoring spring, said open ring portion will allow the extension of the restoring spring as biased by the two cam portions formed on the pivots of the half-shell pieces.

6. A pacifier according to claim 2, wherein the anti-swallow shield includes a cap portion, and two outer pin holes formed through the cap portion for passing each of the two ratchet-toothed pin of the handle through each outer pin hole to be engaged in each said pin hole formed in the base member for pivotally connecting the handle to the base member through the anti-swallow shield.

7. A pacifier according to claim 1, wherein said anti-swallow shield includes: a cap portion secured to a rear portion of the base member, and a pair of wing portions disposed on opposite sides of the cap portion, each said wing portion having an opening formed therein.

8. A pacifier according to claim 1, wherein said nipple member, said base member and said anti-swallow shield are integrally formed.

9. A pacifier comprising:

a base member;

a nipple member formed on a front portion of the base member;

a bivalve shell hingedly secured to the base member; and an anti-swallow shield circumferentially secured to the base member having openings formed in said shield allowing a rearward protruding of the bivalve shell when opened for safely preventing the swallowing of the pacifier; and the bivalve shell normally closed as urged by a restoring spring retained on the base member for encasing the nipple member within said shell for hygienic protection of the nipple member when dropped to the ground.

* * * * *